US009433284B2

(12) United States Patent
Miranda

(10) Patent No.: US 9,433,284 B2
(45) Date of Patent: Sep. 6, 2016

(54) MODULAR RECONFIGURABLE CARCASS SYSTEM FOR FURNITURE

(76) Inventor: Pedro A. Miranda, Guaynabo, PR (US)

( * ) Notice: Subject to any disclaimer, the term of this patent is extended or adjusted under 35 U.S.C. 154(b) by 0 days.

(21) Appl. No.: 13/015,600

(22) Filed: Jan. 28, 2011

(65) Prior Publication Data

US 2016/0095429 A1 Apr. 7, 2016

(51) Int. Cl.
*A47B 45/00* (2006.01)
*A47B 47/00* (2006.01)

(52) U.S. Cl.
CPC ..... *A47B 47/0091* (2013.01); *A47B 45/00* (2013.01); *A47B 47/0066* (2013.01); *A47B 47/0075* (2013.01)

(58) Field of Classification Search
CPC ..... A47B 47/0041; A47B 47/00; A47B 47/0075; A47B 47/04; A47B 47/042; A47B 47/047
See application file for complete search history.

(56) References Cited

U.S. PATENT DOCUMENTS 5,865,126 A * 2/1999 Miranda ..... A47B 87/0246 108/180
7,686,173 B2 * 3/2010 Robinson ..... A47B 57/30 211/187
2007/0145865 A1 * 6/2007 Richter ..... A47B 47/025 312/111
2008/0302279 A1 * 12/2008 Clifton ..... A47B 47/042 108/60
2011/0025181 A1 * 2/2011 Vinke ..... A47B 57/20 312/257.1
2013/0234576 A1 * 9/2013 Hixson ..... A47C 13/005 312/265.5
2014/0048176 A1 * 2/2014 Susnjara ..... A47B 47/042 144/344
2014/0169869 A1 * 6/2014 Brumfield ..... A47B 47/042 403/373
2015/0368896 A1 * 12/2015 Schulte ..... E04B 1/54 403/364

* cited by examiner

*Primary Examiner* — Daniel Rohrhoff

(57) ABSTRACT

At least two vertical supports have vertical arrays of edge shelf-receiving protrusions and notches that support shelving in the notches with bottom recessions to fit over the protrusions. Top tabs and bottom tab receiving caps enable vertical expansion of the vertical supports in vertically stacked arrays. The caps also attach to horizontal tie members which may expand horizontally in linear arrays. The components secure together in rectangular configurations of various shapes and sizes forming a modular reconfigurable furniture carcass system. Shelves, drawers or doors are added to the carcass to form variety of different furniture pieces.

12 Claims, 8 Drawing Sheets

MODULAR RECONFIGURABLE CARCASS SYSTEM FOR FURNITURE

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to knock-down furniture and particularly to a modular reconfigurable furniture carcass system which can be configured into any of a variety of different types and sizes of furniture including vertically and horizontally expandable bookcases, drawer chests, armoires, cabinets, and other pieces of furniture which have in common a box, called a carcass, into which shelves, drawers or doors are added according to its particular intended use, which furniture carcass comprises a bottom and top horizontal tie board or tie shelf, at least two vertical supports with vertical edge arrays of shelf-receiving spaced protrusions with notches formed between the protrusions, the vertical supports attached between the tie boards, at least one height adjustable horizontal planar member fitting in any of the mating notches, and other specific elements to form the desired piece of furniture.

2. Description of Related Art Including Information Disclosed Under 37 CFR 1.97 and 1.98

Most furniture is single use with rigidly permanently connected components structured of a specific size and shape for a specific use. Some prior art modular furniture units have some flexibility in terms of shape, but are generally limited in expansion capability and limited to a single type of use.

U.S. Pat. No. 5,865,126, issued Feb. 2, 1999 to Miranda, describes an adjustable expansible interlocking modular structural system and method. Interlocking modular elements are each formed by two side panels spaced apart in parallel face-to-face alignment sandwiching two protruding elongated elements spaced apart in planar alignment forming a slot therebetween. A series of interlocking modular elements stacked vertically in an alternating orthogonal array interlock with slots intersecting adjacent slots and panels to form a vertical structural support. In a preferred embodiment, the space between elongated elements is equal to the width of one elongated element. Each protrusion of each elongated element creates a tenon insertable in each mortice between elongated elements to form a coplanar vertical structural support. Alternately, second modular elements are formed with two spaced parallel side panels sandwiching a single elongated element protruding above and below the side panels. Horizontal slots are formed between side panels. First horizontal elements formed of a single rigid member slide into the horizontal slots and edge slots engage the side panels to lock them in. Second horizontal elements are each formed by two spaced apart planar aligned planks interconnected by a shorter plank leaving a slot at each end to engage orthogonally stacked modular elements. Sliding drawer-like storage elements may also be supported in the slots. Tie members interconnect vertical structural supports. A series of paired vertical structural supports with horizontal elements therebetween may be stretched out in one plane and in orthogonal planes. An adjustable brace element having at least one diagonal component connects between the top and bottom of the structure.

U.S. Pat. No. 4,562,776, issued Jan. 7, 1986 to Miranda, claims a modular expansible interlocking support structure. Rectangular planar support members are slotted and interlocked to form vertical support structures. Elongated members slotted at each end are interlocked into the vertical support structure in horizontal and vertical orientations. The system is expansible in aligned or angled planes between vertical support structures spaced apart by the length of the elongated members. Components are easily assembled into myriad structures and disassembled to stack flat for storage. Each rectangular planar support member is slotted on four edges and provided with a tab on one edge. When the planar support members are interlocked together they form a column cross-shaped in cross-section and having slots extending in all four directions. The structural system therefore may be expanded in any of these directions by inserting elongated members in the slots and by adding columns as desired for multidirectional multiform structures.

U.S. Pat. No. 6,675,979, issued Jan. 13, 2004 to Taylor, provides a furniture assembly system which utilizes upright members having a pair of protruding hook portions that cooperate with a similar pair of hook portions of another upright member and mutually interconnect through slots in a shelf to hold the shelf in place. A plug inserts into an aperture formed by the interconnecting hook portions to hold the upright members in place and secondarily to provide further support to the shelf.

U.S. Pat. No. 3,807,572, issued Apr. 30, 1974 to Luvara et al, shows an adjustable compartment size storage unit. The units may be divided into vertical and/or horizontal compartments by the use of universally-fitting partitions. In particular, the horizontal partitions are formed so as to be readily assembled or disassembled while still providing a structure that will support a substantial weight placed thereon. The units are designed to be used in conjunction with other similar units to form almost any desired configuration of compartments.

U.S. Pat. No. 5,806,438, issued Sep. 15, 1998 to Beaudet, provides an adjustable shelf system having vertical left and right end panels, one or more center panels, top and bottom panels for holding the end panels and center panels in spaced relation and a back panel. A plurality of shelves may be adjustably positioned at various levels between the end panels and center panels. Each of the end panels and center panels is formed with support loops that are interlockably engaged by insertable tabs formed on the left and right sides of each shelf Alignment tabs on each shelf side defined common left and right lower edges that guide the shelf into its proper position during assembly and subsequent repositioning. The support loops on opposed vertical panels (e.g., the left end panel and the center panel) are structurally different and unique to the left and right sides of the shelf, respectively, so that the shelf can be insertably mounted in only a single orientation and at the proper depth within the shelf system.

U.S. Pat. No. 3,756,581, issued Sep. 4, 1973 to Albertini, puts forth cell-shaped assemblies of firing setters for individually and spacably supporting a plurality of tiles and other ceramic ware during the firing of the glaze in a firing kiln comprise upright wall components made of refractory material with laterally extending projections for supporting the tiles. Further, transverse or horizontal components, also formed of ceramic material, with complementary configurations for interengaging transverse components in a coplanar manner, are provided and interlink the top and bottom ends of the upright components with the edge portions of the transverse components affording an essentially loose interfitting engagement of the components to provide an assembly made of a plurality of superimposed and side-by-side located cells.

U.S. Pat. No. 7,686,173, issued Mar. 30, 2010 to Robinson et al, is for a modular shelving system including a number of separate, selectively inter-connectable pieces, and methods of assembling such a shelving system. The selectively inter-connectable pieces of the shelving system include vertical supports columns, cap shelves for attachment thereto, hanging rods, and adjustable shelves and drawers and selectively placeable support elements for supporting same.

U.S. Pat. No. 6,126,022, issued Oct. 3, 2000 to Merkel, discloses shelving consisting of components which are assembled with securing elements. The invention contains a frame having a back wall, a pair of side walls, a top wall and a bottom wall attached to each other with a plurality of tabs and corresponding slots located on the back wall, side walls, top wall and bottom wall. The back wall, side walls, top wall and bottom wall are constructed of folded material which provides rounded edges that limit damage to material stored on the shelf. A securing bore is located on each of the tabs and is milled to a particular diameter corresponding to the type of material used to construct the shelf and the load supported. A plurality of safety bars are inserted through the securing bore located on each of the tabs. The safety bars prevent the removal of the tabs from the corresponding slots and help secure the shelf. In addition, horizontal and vertical compartment divider may be attached to the frame using the same tab and slot method. The additional compartment divides allow for an unlimited number of compartments.

U.S. Pat. No. 3,695,190, issued Oct. 3, 1972 to Bucholz, indicates knockdown sectional shelving comprising a plurality of shelf units arranged one above the other and demountably interconnected and spaced by a plurality of connectors. Each of the shelf units comprises a horizontal shelf having a pair of vertical end pieces mounted, one on each end of the shelf and projecting above and below the same. One of the connectors is interposed between and bears against the end pieces of each adjacent pair of shelf units. Tongue and groove means demountably interconnect the end pieces and connectors. Where the end pieces are planar, the projections thereof constitute the tongues which cooperate with grooves on the connectors in interconnecting the two elements of the assembly. The shelving thus may be demountably assembled in various multiples and configurations to meet the requirements of contemplated end uses.

U.S. Pat. No. 3,861,327, issued Jan. 21, 1975 to Silson, illustrates a shelf support for a collapsible bookcase. The shelf support is a stackable, invertible H-shaped vertical member which has first and second vertical posts and first and second cross bars interconnecting said posts. The vertical posts and cross bars define a slot in the member through which a shelf may be inserted and supported. The slot is preferably located away from the center of the vertical post so that by inverting the support member, shelves of different heights may be made. The vertical posts also have mating portions on the ends to allow for stacking of the support member for multiple shelving.

U.S. Pat. No. 5,893,617, issued Apr. 13, 1999 to Lee, is for a connecting assembly for horizontal boards and wall boards of a cabinet. Each of the horizontal boards and wall boards is formed with clamping channels along lateral sides. The connecting assembly comprises upper T-blocks, lateral T-blocks, inner cross-blocks and L-shaped corner blocks each of which is formed by a vertical slat and at least one horizontal slat. One edge of the vertical slat is formed with shallow or deep dovetail notches at equal intervals. The dovetail notches have reversely inclined faces which are interlaced, or have inclined faces. The horizontal slat has corresponding dovetail tenons spaced from each other by a distance equal to or double that of the dovetail notches.

U.S. Patent Application No. 20070284974, published Dec. 13, 2007 by Buhrman, indicates a modular furniture system kit comprising interchangeable base panels, short side panels, tall side panels, at least one short back panel, at least one tall back panel, at least one horizontal divider, at least one short vertical divider, and at least one tall vertical divider. The base, side, and back panels, and the horizontal and vertical dividers, are selectively assemblable to form at least two disassemblable configurations, including a cubbie configuration and a locker configuration. In certain embodiments, the cubbie configuration includes the base panels, the short side panels, the short back panel, the horizontal divider, and the short vertical divider. Additionally, in certain embodiments, the locker configuration includes the base panels, the tall side panels, the tall back panel, the horizontal divider, and the tall vertical divider.

U.S. Patent Application No. 20050162051, published Jul. 28, 2005 by Madsen et al, puts forth a modular furniture system based on a fundamental building block. The building block, or cell, includes first and second end plates and at least one horizontal support beam. A plurality of stacked and/or side-by-side cells provide a framework that can be arranged in an almost limitless number of ways. The cells serve as both storage space and division between neighboring work spaces, thus conserving raw materials and recovering floor space. The cells further provide raceways for concealing electrical wires and data cables, and are adapted for supporting work surfaces and connecting to vertical panels. The cells are adapted to receive various storage components, such as drawers, which may be inserted from both a front side and a back side of each cell. The cells are also adapted to receive tiles, which may cover open sides of each cell and/or cover the end plates of each cell. The tiles may provide any of a multitude of different aesthetic and functional surfaces. A single cell or stack of cells may include a foundation for increased rigidity and sturdiness.

U.S. Patent Application No. 20060207957, published Sep. 21, 2006 by Chen, illustrates a user configurable stackable display. The display has shelves that can be variable in length with shelf ends that fit within corner pieces. The corner pieces can be arcuate-shaped, T-shaped, and cross-shaped. A locking mechanism such as a cam engages each shelf end such that the shelves are engaged to the corner pieces. A cover piece covers the corner pieces and hides the locking mechanism from view. Each shelf end will fit into the lips of the corner pieces and has one or more bores for receiving a cam bolt that engages the cams. A shelf end may include a raised section that fits within the lips of the corner pieces.

What is needed is a multiple use furniture system using the vertically and horizontally adjustable and expansible furniture carcass of the present invention.

BRIEF SUMMARY OF THE INVENTION

An object of the present invention is to provide a multiple use furniture system using the vertically and horizontally adjustable and expansible furniture carcass of the present invention including vertical end structures having a complete vertical edge arrays of closely spaced paired protrusions sandwiching paired notches to receive horizontal members having underside paired end recesses to slide in and seat on the protrusions to allow easy removal and installation for fine vertical adjustment of the horizontal elements, combined with top and bottom interlocking structured caps on the end structures to facilitate vertical extensions of the system and horizontal tie members with mating structured ends to lock into the caps creating a rigid structure and to facilitate horizontal expansion of the system, all of the elements structured to permit use of the system as a shelving system or as a carcass for a variety of other furniture, such as drawer chests, armoires, desks, and cabinets.

In brief, a modular reconfigurable furniture carcass system which can be configured into any of a variety of different types and sizes of furniture including vertically and horizontally expandable bookcases, drawer chests, armoires, cabinets, and other pieces of furniture which have in common a box, called a carcass, into which shelves, drawers or doors are added according to its particular intended use, which furniture carcass comprises a bottom tie base, at least two vertical supports with shelf-receiving notches thereon, vertical support caps which may be used to stack a plurality of vertical supports, at least one height adjustable horizontal planar member, a top tie horizontal cap member, and other specific elements to form the desired piece of furniture.

Components are assembled without the use of tools and require very few connectors, such as nuts and bolts. A basic shelf cabinet requires only four connectors to complete assembly.

An advantage of the present invention is that it forms a vertically and horizontally expansible furniture carcass.

Another advantage of the present invention is that it can be used for a wide variety of furniture items including shelving of various kinds including both open and closed shelving, desks, cabinets, armoires, and chests of drawers.

One more advantage of the present invention is that the components are easily assembled and dismantled.

Still another advantage of the present invention is that a set of four components fit together compactly to facilitate shipping or storage.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 12:
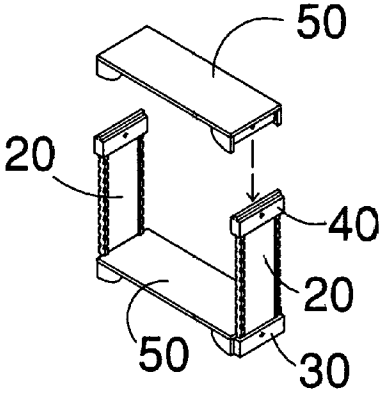
FIG. 12 is a partially exploded perspective view of the minimum components of the basic furniture carcass of the present invention showing the two vertical supports with top and bottom caps attached to a bottom tie member with the top tie member aligned to be installed on the top of the vertical supports to form the basic furniture carcass.
Figure 13:
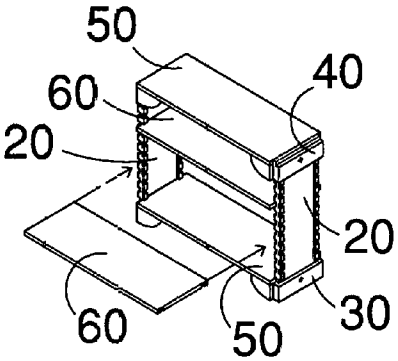
FIG. 13 is a partially exploded perspective view of the assembled components of the basic furniture carcass of the present invention showing the two vertical supports with top and bottom caps attached to a top tie member and a bottom tie member with one shelving member installed between the vertical supports and another shelving member aligned to be installed at a different height between the vertical supports to form an open shelving piece of furniture.

In FIGS. 1-31, an adaptable furniture carcass system comprises at least two vertical supports 20 each comprising a rigid vertically elongated planar member having front and back side edges lined with vertical arrays of spaced protrusions 24 and spaced notches 25 between the edge protrusions to receive a plurality of horizontal shelf members 60 each having two spaced bottom edge recesses 62 so the shelf members slide into the notches and drop down onto the edge protrusions with the edge protrusions in the recesses supporting the shelf members at any desired height between the two vertical supports. A top tab 21 of each of the vertical supports inserts alternately into a bottom support cap 30 of another vertical support attached on top which enables vertically stacking the vertical supports in vertical arrays to expand the carcass vertically or alternately onto a top cap 40 to attach to a top horizontal tie board or tie shelf 50. The bottom support caps 30 and top support caps 40 may both connect to an end of a horizontal tie board 50 or tie shelf to secure the vertical supports in spaced alignment, as shown in FIGS. 12 and 13. Horizontal tie boards 50 or tie shelves may attach to both sides of a support cap 30 or 40 to enable horizontal arrays of the tie boards 50 or tie shelves to expand the carcass horizontally, as shown in FIG. 19.

Figure 19:
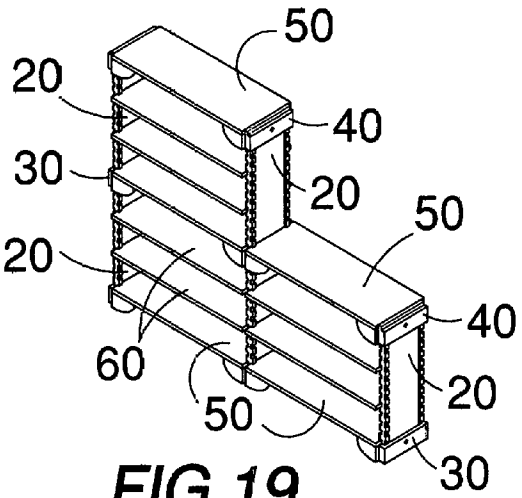
FIG. 19 is a perspective view of the vertically stacked array of two sets of pairs of vertical supports attached by caps and attached to a bottom and top tie members of FIG. 18, showing an additional horizontal extension comprising a second bottom tie member attached in horizontal alignment with the first bottom tie member, a second top tie member attached to the middle cap and another vertical support attached between the second top tie member and the extended bottom tie member with the shelving members installed in a compoundly extended shelving unit piece of furniture.

A single connector, such as a single bolt with a nut, can fasten together a vertical support tab 21, a vertical support cap 40 and one adjacent tie board 50, as shown in FIGS. 12 and 13, or two adjacent tie boards 50 or tie shelves, as shown in FIG. 19, at the tie board's vertical planar attaching member 53, threading together holes 22, 32, 42, and 52.

The vertical planar attaching member 53, placed perpendicular and rigidly connected by to vertical corner brackets 54 to the horizontal planar member 51, and attached to the vertical support 20 by threading a connector, such as a bolt with a nut, through perforations 52, 22, 32, or 42, makes a rigid connection between the vertical support 20 and the horizontal tie board or tie shelf 50 so carcass assembly, as shown in FIG. 12, will resist racking and remain square.

Securing the bottom support cap 30 to the tab 21 of the adjacent stacked vertical component 20 by threading a connector, such as a bolt with a nut, through perforations 22 and 32, makes a rigid connection between the two stacked vertical supports 20, so that a carcass assembly, as shown in FIG. 12 will resist racking and remain square.

Figure 3:
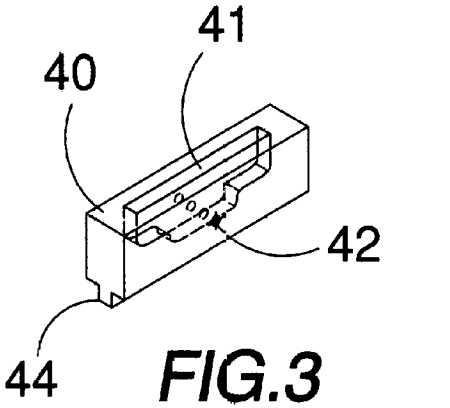
FIG. 3 is a perspective view of the top cap for the vertical support of the present invention showing the top cap inverted.
Figure 4:
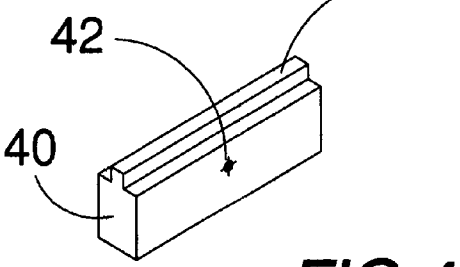
FIG. 4 is a perspective view of the top cap for the vertical support of FIG. 3 showing the top cap upright in the normal use orientation.

In FIGS. 3 and 4, a vertical support top cap 40 has a bottom cap receiving slot 41 with a transverse connector opening 42 to receive a top protruding tab 21 with transverse tab opening 22 of the vertical support and top protruding tab 44 to secure to a top horizontal tie board or tie shelf, as shown in FIGS. 12 and 13.

Figure 6:
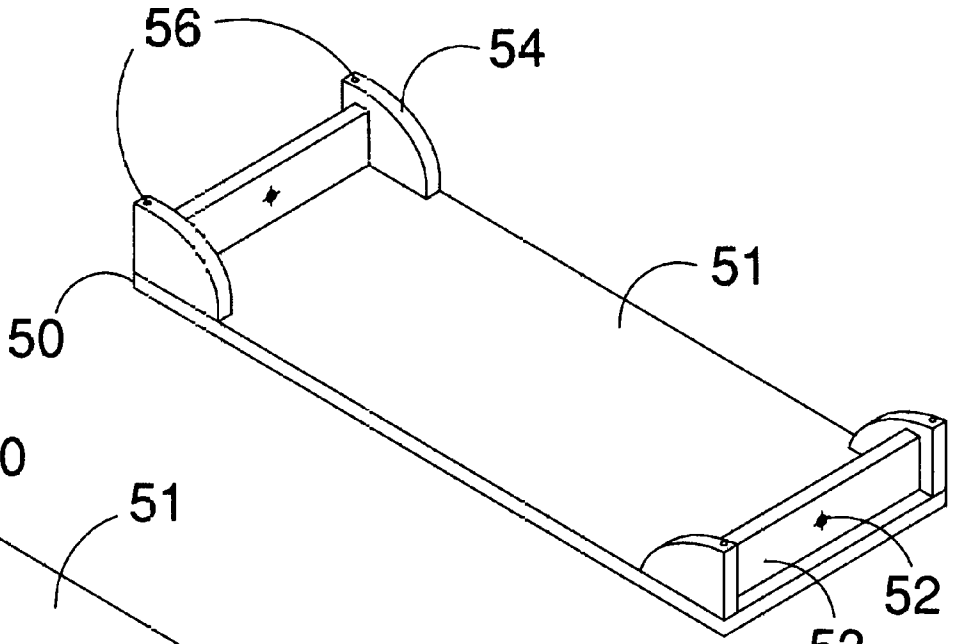
FIG. 6 is a perspective view of the horizontal tie board or tie shelf used as both a top and bottom horizontal tie board or tie shelf of FIG. 5 showing the horizontal tie board or tie shelf inverted to show the bottom.
Figure 5:
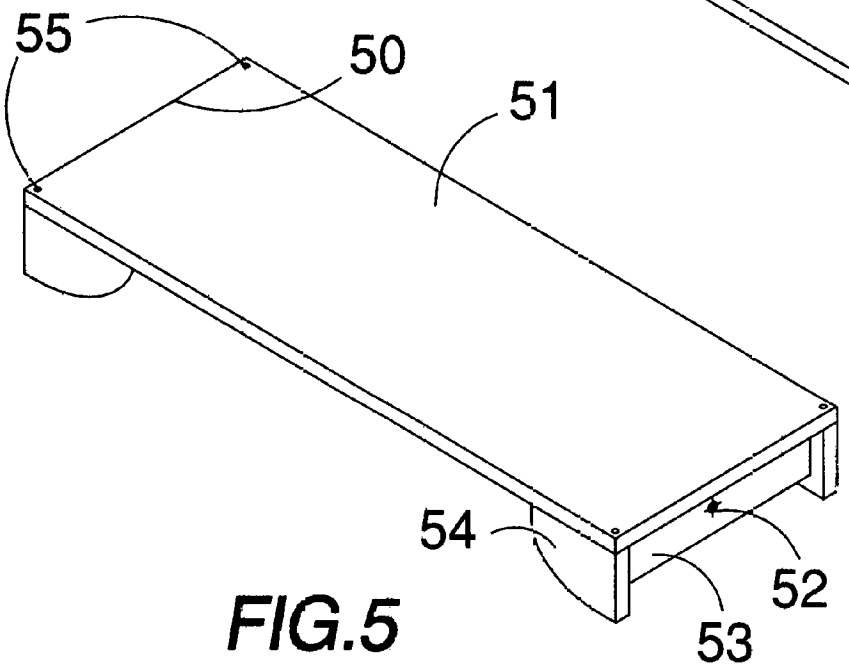
FIG. 5 is a perspective view of the horizontal tie board or tie shelf used as both a top and bottom horizontal tie board or tie shelf of the present invention showing the horizontal tie board or tie shelf upright in the normal use orientation.

In FIGS. 5 and 6, the modular reconfigurable furniture carcass construction comprises a horizontal tie board 50 or tie shelf structured the same for a bottom, middle, or top horizontal tie board or tie shelf, the horizontal tie board 50 comprising a rigid horizontal planar tie member 51 and a vertical planar attaching member 53 at each end having transverse opening 52 therethrough to receive a connector and vertical corner brackets 54 at each end of the horizontal planar member 51 as a means to connect two vertical supports 20 rigidly spaced apart, as shown in FIGS. 12 and 13, and to connect to an adjacent aligned bottom horizontal tie board 50 to extend the system horizontally, as shown in FIG. 19.

Figure 30:
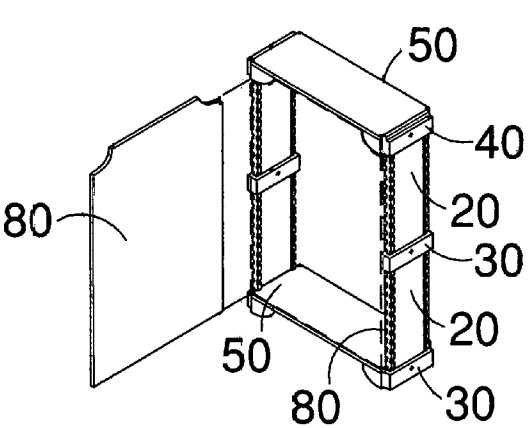
FIG. 30 is a perspective view of a vertically stacked array of two sets of pairs of vertical supports attached to bottom and top tie members of FIG. 18, with one tall door member of FIG. 27 in a closed position shown in dashed lines and the same door member of FIG. 27 aligned for installation to form an armoire piece of furniture.
Figure 31:
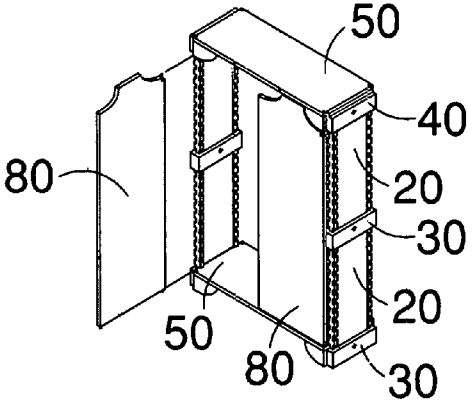
FIG. 31 is a perspective view of a vertically stacked array of two sets of pairs of vertical supports attached to bottom and top tie members of FIG. 18 with one tall door member of FIG. 27 in a closed position and another tall door member of FIG. 27 on opposite vertical support and aligned for installation to form an armoire piece of furniture.
Figure 29:
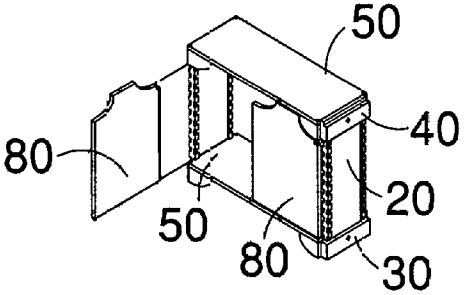
FIG. 29 is a partially exploded perspective view of the assembled components of the basic furniture carcass of the present invention showing the two vertical supports with top and bottom caps attached to a top cap member and a bottom tie member with one door member of FIG. 27 in a closed position and another door member of FIG. 27 aligned for installation on the opposite vertical support to form a cabinet piece of furniture.

In FIGS. 5 and 6, the modular reconfigurable furniture carcass construction comprises a horizontal tie board 50 or tie shelf structured the same for a bottom, middle, or top horizontal tie board or tie shelf, the horizontal tie board 50 comprising a rigid horizontal planar tie member 51 and two pairs of perforations at each end of horizontal tie board 50, two perforations 55 on top surface as shown in FIG. 5 and two perforations 56 on bottom surface of vertical corner brackets 54 as shown in HU. 6 to attach door 80 as shown in FIGS. 29-31.

Figure 14:
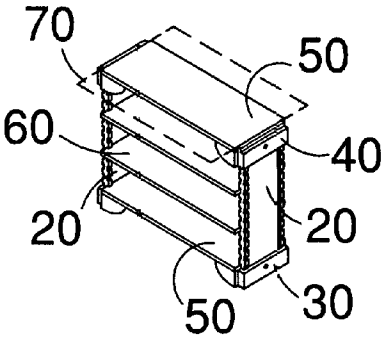
FIG. 14 is a perspective view of the fully assembled components of the open shelving piece of furniture of FIG. 13.
Figure 15:
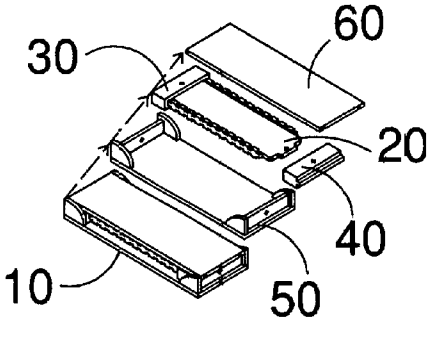
FIG. 15 is an exploded perspective view of half of the components of the basic furniture carcass of the present invention stacked together for storage or shipping at the bottom of the figure and the top three exploded components above as they are unpacked for use.

In FIGS. 1-4, at least two vertical supports 20 are each attached to a recessed vertical support attaching member 53 at one end of the bottom horizontal tie board 50 and extend vertically therefrom so that each pair of vertical supports are in parallel vertical alignment spaced apart by the horizontal tie board, as shown in FIG. 12. Each of the vertical supports 20 comprises a rigid vertical planar member having a top protruding tab 21 and a bottom support cap 30 having a transverse connector receiving opening 32. Each of the tabs has a transverse connector receiving opening 22 for receiving a fastener therein. The vertical support 20 further comprising a series of aligned spaced edge protrusions 24 having spaced notches 25 therebetween, formed in one vertical element 23 extending vertically along the height of each vertical edge of the end supports with the spaced edge protrusions extending from both a front face and a back face. In FIGS. 13 and 14 the front face protrusions align with edge protrusions and notches on a front face of the vertical support 20 at an opposite end of the horizontal tie board 50 to receive a plurality of horizontal planar members 60 therebetween supported at any desired height.

Figure 8:
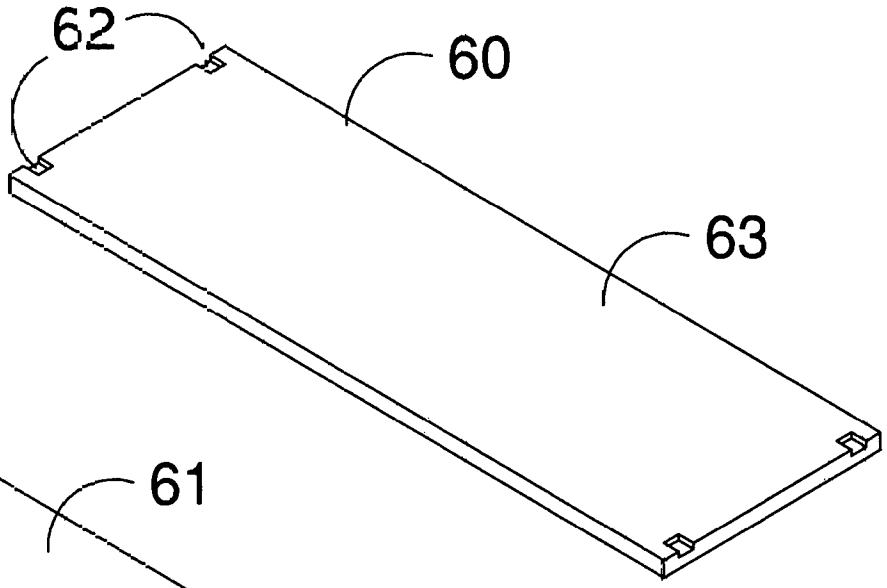
FIG. 8 is a perspective view of the shelving member of FIG. 7 showing the shelving member inverted to show the bottom with the spaced edge recesses.
Figure 7:
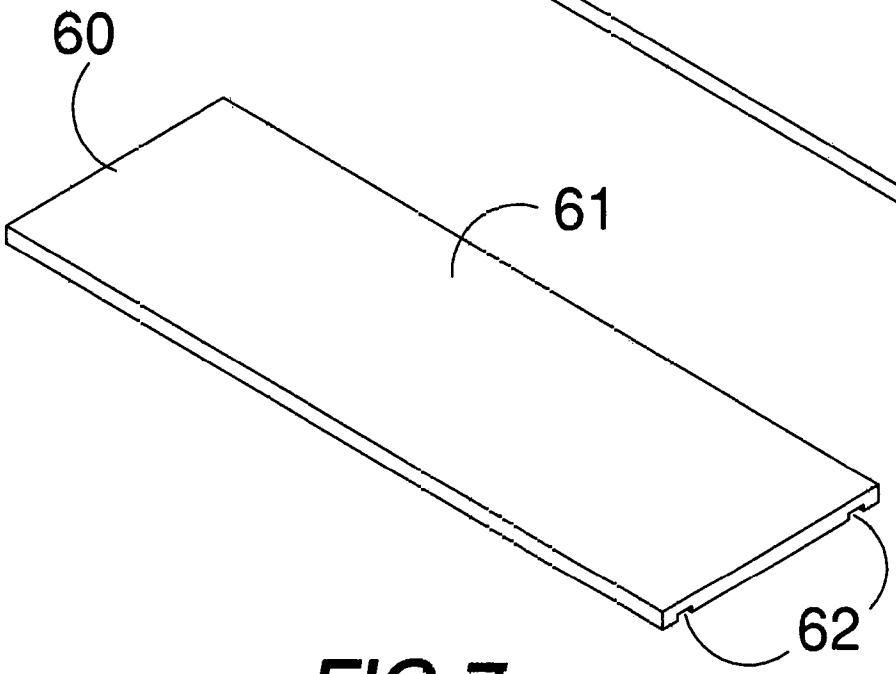
FIG. 7 is a perspective view of a horizontal shelving member of the present invention showing the shelving member upright in the normal use orientation.

In FIGS. 7 and 8, at least one height adjustable rigid horizontal planar shelf member 60 is removably secured between each parallel aligned pair of vertical supports 20 at any desired height. Each shelf member comprises a rigid elongated planar member 61 having a thickness to fit slidably in any of the notches 25 between the protrusions 24 along the edge of each vertical support 20, as shown in FIGS. 13 and 14. Each of the shelf members has a pair of recesses 62 on a bottom face of each end. The pair of recesses 62 align with the pair of vertical spaced tabs 24 so that each shelf member slides into aligned notches 25 between the two vertical supports and drops down with each of the bottom recesses 62 engaging one of the edge protrusions 24.

Figure 2:
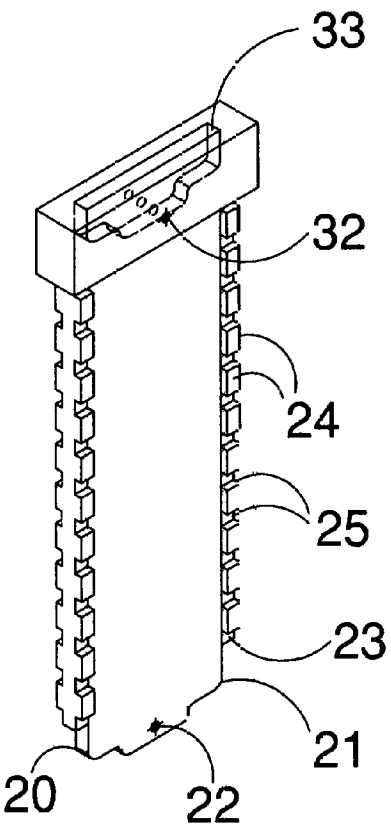
FIG. 2 is a perspective view of the vertical support of FIG. 1 showing the vertical support and attached base cap inverted to see the underside of the cap.
Figure 1:
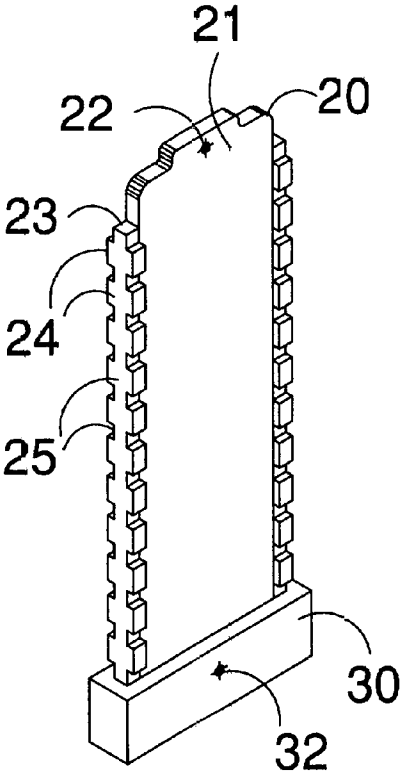
FIG. 1 is a perspective view of one of the vertical supports inserted in a base cap showing the double array of vertically spaced protrusions and sandwiched notches along the vertical length of both side edges of the vertical support.
Figure 16:
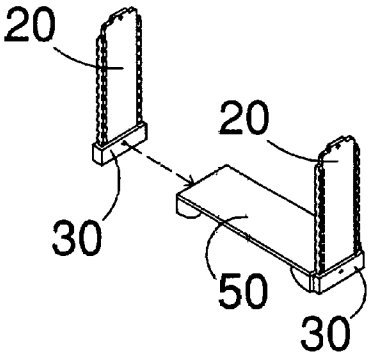
FIG. 16 is a partially exploded perspective view of one of the vertical supports and bottom cap attached to one end of a bottom tie member of the basic furniture carcass of the present invention showing a second vertical support with bottom cap aligned to be installed on the other end of the bottom tie member.
Figure 17:
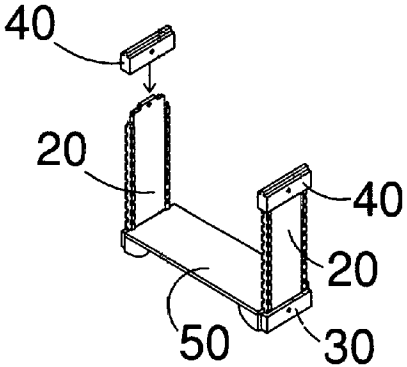
FIG. 17 is partially exploded perspective view of one of the two vertical supports with bottom caps attached to a bottom tie member of the present invention with a top cap attached to one of the vertical supports and another top cap aligned to be installed on the top of the other vertical support.
Figure 18:
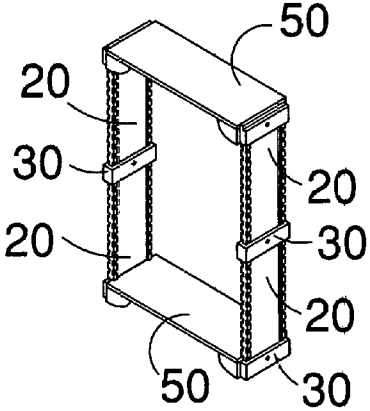
FIG. 18 is a perspective view of a vertically stacked array of two sets of pairs of vertical supports attached to a bottom and top tie members.

A vertical support bottom cap 30, as shown in FIGS. 1 and 2, has a flat bottom surface to rest on a horizontal surface and a bottom tab receiving slot 33 in the flat bottom surface to receive a top protruding tab 21 of a lower vertical support 20 for vertical stacking of vertical supports 20, as shown in FIG. 18. Each of the vertical support caps 30 has a transverse opening 32 therein to receive a fastener through the transverse opening for securely attaching the tabs 212 through the tab openings 22 and to the bottom horizontal tie board 50, as shown in FIG. 16.

Figure 10:
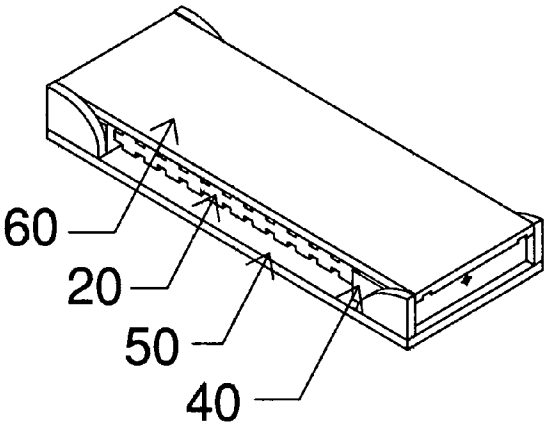
FIG. 10 is a perspective view of half of the components of the basic furniture carcass of FIG. 9 stacked together for storage or shipping.
Figure 11:
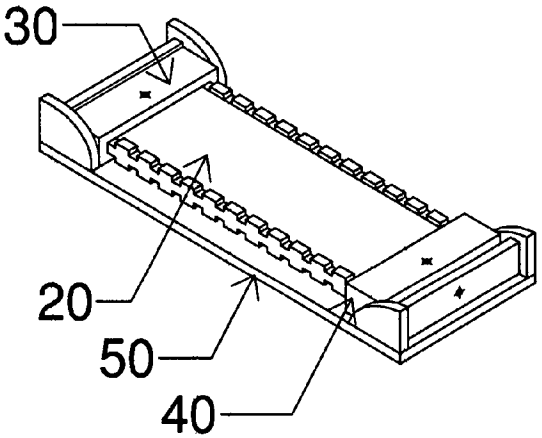
FIG. 11 is a perspective view of half of the components of the basic furniture carcass of FIG. 10 stacked together for storage or shipping with the horizontal shelving member removed to show the vertical support fitting within the bottom of the tie member.
Figure 9:
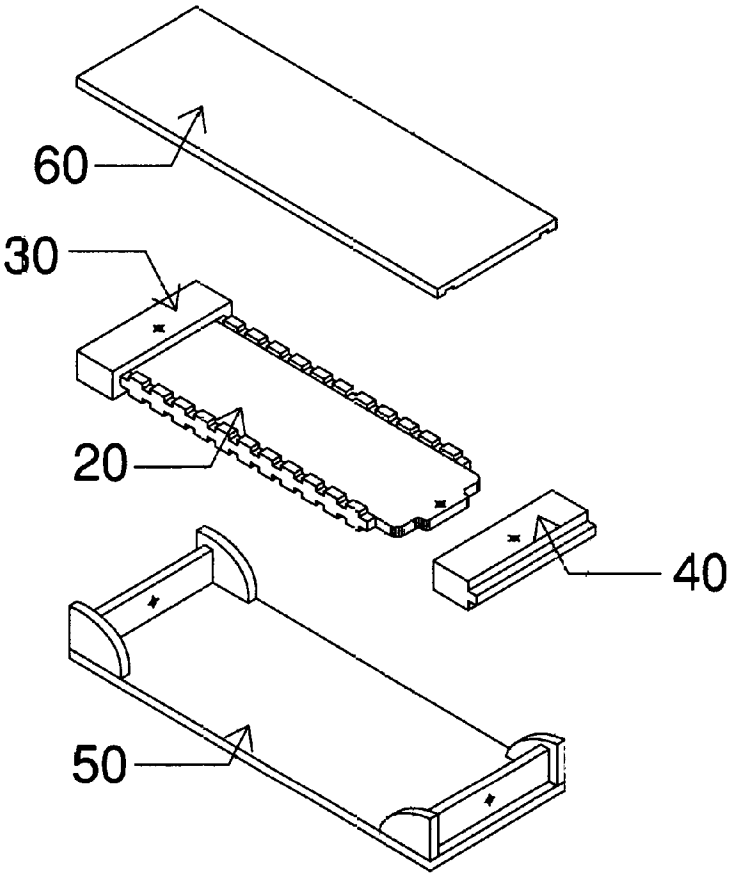
FIG. 9 is an exploded perspective view of half of the components of the basic furniture carcass of the present invention aligned to be stacked together for storage or shipping.

A set of four components, as shown in FIGS. 9, 10 and 11, fit together compactly to facilitate shipping or storage.

In FIGS. 13 and 14, a plurality of rigid horizontal planar elements 60 are inserted at different heights between the vertical supports 20 to form an adjustable open shelving piece of furniture.

In FIG. 14, the horizontal planar top tie member may comprise a desktop 70 to form a desk.

Components are assembled without the use of tools and require very few connectors, such as nuts and bolts. For example, a basic shelf cabinet, as shown in FIG. 14, requires only four connectors.

In use, the adjustable multiple use furniture system has vertical end structures having a complete vertical array of closely spaced paired protrusions to receive horizontal members having underside paired end notches to slide in and seat on the protrusions to allow easy removal and installation for fine vertical adjustment of the horizontal elements, combined with top and bottom interlocking structured caps on the end structures to facilitate vertical extensions of the system and horizontal tie members with mating structured ends to lock into the caps creating a rigid structure and to facilitate horizontal expansion of the system, all of the elements structured to permit use of the system as a shelving system or as a carcass for a variety of other furniture, such as drawer chests, armoires, desks, and cabinets.

FIGS. 12-17 show the progression of steps in creating a low open shelving piece of furniture with two vertical supports with top and bottom caps attached to a top tie member and a bottom tie member with two shelving members installed at different heights.

FIG. 18 shows a double height furniture carcass without a middle tie board or tie shelf formed by attaching two pairs of vertical supports in vertical arrays.

Figure 22:
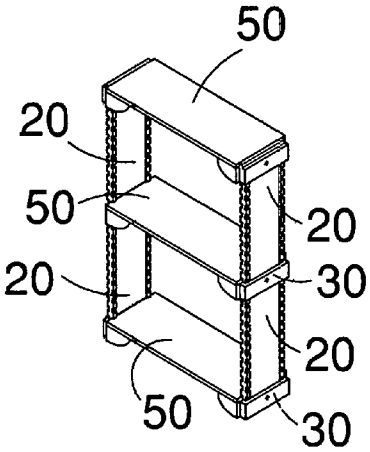
FIG. 22 is a perspective view of the two vertical supports with bottom caps attached to a bottom tie member with a second identical unit attached on top of the two vertical supports to form a vertical extension of FIG. 21 and having a top tie member attached on top of the two vertical supports.

FIG. 19 shows a horizontal extension of the double height furniture carcass of FIG. 22 with a middle tie board or tie shelf with an additional single height carcass or box similar to FIG. 13 forming a compound shelving unit extending up and out to one side.

Figure 21:
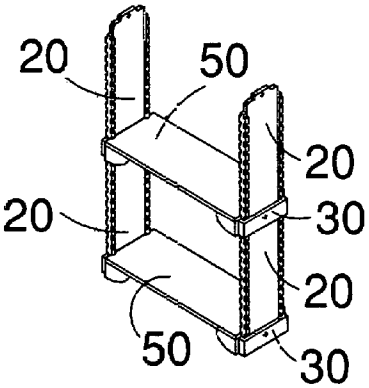
FIG. 21 is a perspective view of the two vertical supports with bottom caps attached to a bottom tie member of FIG. 20 with a second identical unit attached on top of the two vertical supports to form a vertical extension.
Figure 20:
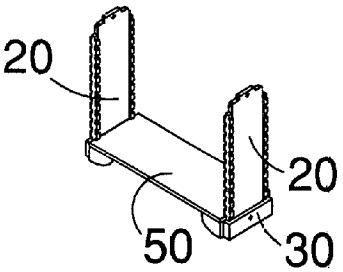
FIG. 20 is a perspective view of the two vertical supports with bottom caps attached to a bottom tie member of the present invention.
Figure 25:
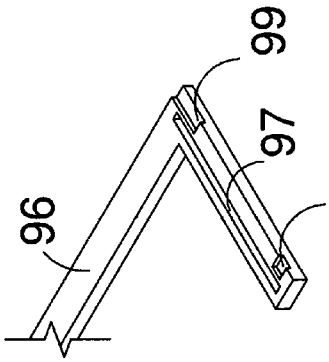
FIG. 25 is a partial perspective view of the underside of the drawer slide of FIG. 23 with spaced edge recesses.

FIGS. 20-22 show the process of assembling a double height furniture carcass by vertically attaching two units together, each comprising two of the two vertical supports with bottom caps attached to a bottom tie member and having a top tie member attached on the top of the two vertical supports.

Figure 26:
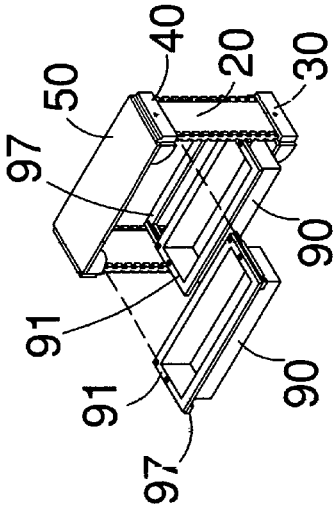
FIG. 26 is a partially exploded perspective view of the assembled components of the basic furniture carcass of the present invention showing the two vertical supports with top and bottom caps attached to a top cap member and a bottom tie member with one drawer assembly member installed, shown partially opened, between the vertical supports and another drawer assembly member aligned to be installed at a different height between the vertical supports to form a drawer chest piece of furniture.
Figure 24:
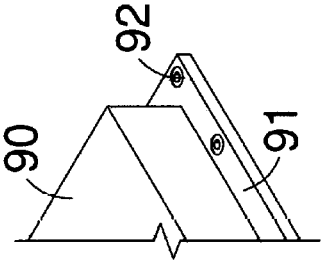
FIG. 24 is a partial perspective view of the underside of the drawer box of FIG. 23 with perforations on the drawer sled.
Figure 23:
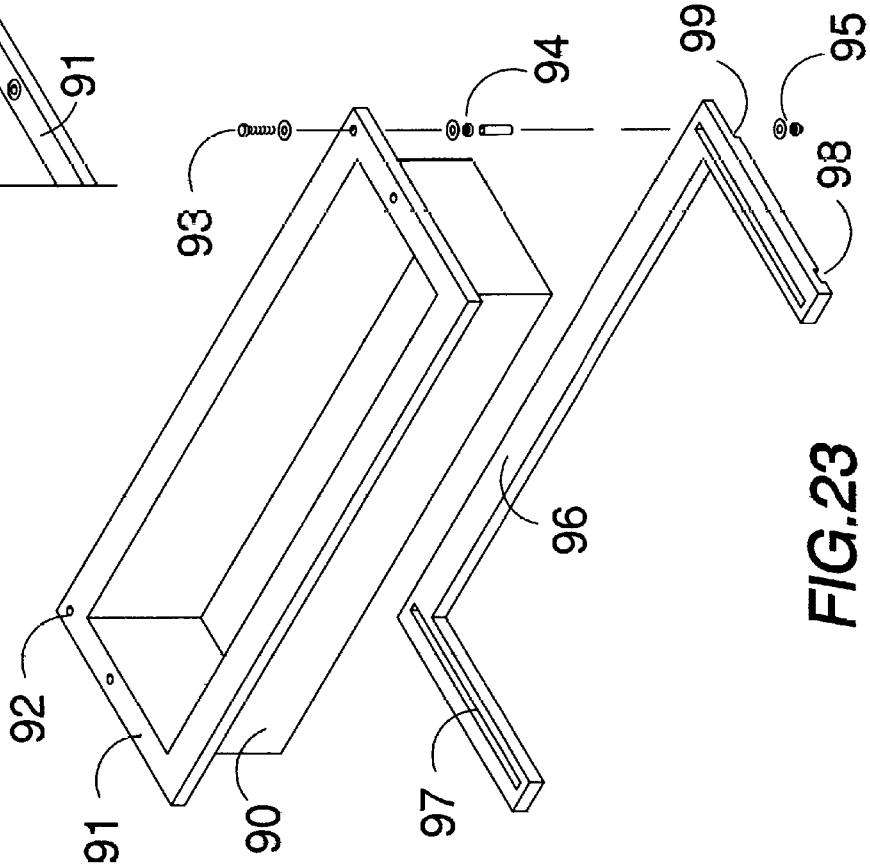
FIG. 23 is an exploded perspective view of a drawer assembly with a drawer box, drawer sled and slide showing the drawer assembly upright in the normal use orientation.

In FIG. 26, a drawer box 90 as shown in FIG. 23 with a rectangular planar ring sled 91, with two pairs of perforations 92 at back corners and partly along opposite sides, each perforation with a screw and washer 93, a washer and nut and bushing 94 at underside of perforation 92 as shown in FIG. 24, resting upon a rectangular planar horseshoe slide 96, with screw 93 and bushing 94 extending through slot 97 along opposite horseshoe arms, closing the screw end with capnut and washer 95 under horseshoe slide, with two pairs of recesses, recess 98 near horseshoe arm's front end and recess 99 at horseshoe arm's corners. Drawer slide 96 having a thickness to fit slidably in any of the notches 25 between the protrusions 24 along the edge of each vertical support 20, as shown in FIG. 26. The pair of recesses 98 and 99 align with the pair of vertical spaced tabs 24 so that each drawer slide member nestles into aligned notches 25 between the two vertical supports and drops down with each of the bottom recesses 98 and 99 engaging one of the edge protrusions 24. Drawer slide 96 arms are wider in order to reach into notches 25 and rest upon protrusions 24 and narrower drawer sled 91 sides slide between protrusion 24 faces. Drawer sled 91 glides over drawer slide 96 guided by screws with bushing, running back and forth along slot 97 as shown in partially open drawer in FIG. 26, with another drawer assembly also shown aligned for installation above. A plurality of drawers 90 are inserted at different heights between the vertical supports 20 to form a chest of drawers.

Figure 28:
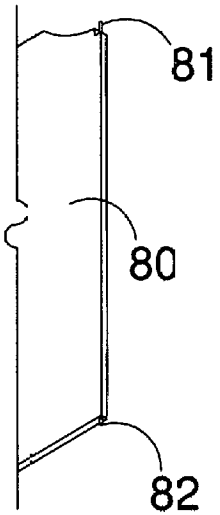
FIG. 28 is a partial perspective view of the underside of a door member with pivot pins on its hinge stile side.
Figure 27:
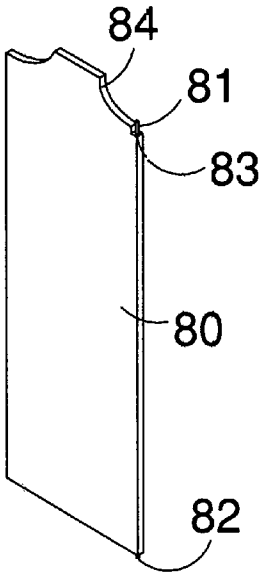
FIG. 27 is a perspective view of a door member with pivot pins on its hinge stile side.

In FIGS. 29-31, at least one vertical door 80 is installed by means of a top long pin 81 with notch 83 and a bottom short pin 82 as shown in FIGS. 27 and 28, while holding door perpendicular to carcass, door is installed by inserting pin 81 into perforation 56 on the bottom of member 54 of the top tie member shown in FIG. 6, lifting door 80 so notch 83 reaches perforation 56, bottom short pin 82 slides over perforation 55, lowering bottom short pin 82 into perforation 55 of the bottom tie member for pivoting the at least one door next to at least one vertical support 20 to form a cabinet or armoire with at least one tall vertical door 80 attached and hinged between top and bottom tie boards or tie shelves by means of pins, next to at least one stacked pairs of vertical supports, at least one tall door covering the area between the vertical supports to form an armoire.

The adjustable and expansible furniture carcass of the present invention may be formed into a variety of sizes and shapes forming boxes or furniture carcasses to receive shelves, drawers, doors, desktops and other elements to form bookcases, drawer chests, armoires, desks, and cabinets.

The present invention may be fabricated of natural wood, pressed wood, laminated wood, sheet metal, plastic, or other synthetic material depending on the intended usage, or a combination of materials, in which case, component proportions will vary. Connectors, such as bolts and nuts preferably, or pegs, screws or other types of connectors may be used in the various transverse openings 22, 32, 42, and 52 to secure elements together.

It is understood that the preceding description is given merely by way of illustration and not in limitation of the invention and that various modifications may be made thereto without departing from the spirit of the invention.

What is claimed is:

1. An adaptable and expansible furniture system that comprises: at least two vertical supports spaced apart in parallel alignment, each of the supports comprising a rigid vertically elongated planar member having front and back side edges each lined with vertical arrays of spaced edge protrusions and spaced notches between the edge protrusions, and further comprising a protruding top tab having a transverse tab opening therethrough and a bottom support tab having a bottom tab receiving slot therein and a transverse cap opening therethrough to receive a protruding top tab from another vertical support in the tab receiving slot having the transverse cap opening and the transverse tab opening in alignment to receive a connector therethrough so that a plurality of vertical supports are stackable in a vertical array for a vertically expansible furniture structure; a top horizontal tie board and a bottom horizontal tie board each comprising a rigid elongated planar board having an attached vertical planar attaching member recessed from each end of the board and having a transverse connector opening through the vertical planar attaching member to receive one of the caps attached to the vertical planar attaching member with a connector attached through the transverse openings to rigidly support the vertical supports to form a furniture structure, wherein an additional horizontal tie board is attachable to an opposite side of the cap to enable horizontal arrays of the horizontal tie boards to expand the furniture structure horizontally; at least one horizontal shelf member having two spaced bottom edge recesses on each end so each shelf member slides into any aligned notches in the vertical supports and drops down onto the edge protrusions with the edge protrusions in the bottom edge recesses to support the at least one horizontal member at any required height.

2. The system of claim 1 wherein the at least one height adjustable rigid horizontal planar shelf member comprises a plurality of horizontal planar elements insertable at different heights between the vertical supports to form an adjustable open shelving piece of furniture.

3. The system of claim 2 further comprising a plurality of drawers instead of planar shelf members insertable at different heights between the vertical supports to form an adjustable drawer chest piece of furniture.

4. The system of claim 1 further comprising at least one vertical door attached by means for pivoting the at least one door between a top tie board and a bottom tie board next to a vertical support to form a cabinet.

5. The system of claim 1 wherein the horizontal planar top tie member comprises a desktop to form a desk.

6. The system of claim 1 wherein the at least one pair of vertical supports comprises a vertically stacked array of at least two sets of pairs of vertical supports and further comprising at least one tall door attached by pins between a top tie board and a bottom tie board next to at least one of the stacked pairs of vertical supports, the at least one tall door covering the area between the vertical supports to form an armoire.

7. An adaptable furniture carcass system comprising: a modular reconfigurable furniture carcass construction, comprising a bottom horizontal tie board and a top horizontal tie board, each comprising a rigid horizontal planar tie member and a receiving opening at each end of the horizontal planar member and means to connect to an adjacent aligned horizontal tie board to extend the system horizontally; at least two vertical supports each attached to the receiving opening at one end of the bottom and top horizontal tie boards and extending vertically therebetween so that each pair of vertical supports are in parallel vertical alignment spaced apart by the horizontal tie boards, each of the vertical supports comprising a rigid vertical planar member having a top protruding tab and a bottom support cap having a flat bottom surface to rest on a floor and having a tab receiving slot therein and a transverse connector receiving opening to receive a top protruding tab of a lower vertical support in a vertically extensible array of vertical supports, thereby forming a horizontally and vertically expansible furniture carcass structure; the vertical planar member further comprising a series of aligned spaced edge protrusions having spaced notches therebetween extending vertically along the height of each vertical edge of the end supports with the spaced edge protrusions extending from both a front face and a back face, the front face protrusions aligned with the edge protrusions and notches on a front face of the vertical support at an opposite end of the bottom horizontal tie board and the spaced protrusions to receive a plurality of horizontal planar members therebetween support at any desired height; at least one height adjustable rigid horizontal planar shelf member between any parallel aligned pair of vertical supports, each shelf member comprising a rigid elongated planar member having a thickness to fit slidably in any of the notches between the protrusions along the edge of each end support, each of the shelf members having a pair of recesses on a bottom face of each end, the pair of recesses aligning with pair of vertical spaced tabs so that each shelf member slides into aligned notches between the two vertical supports and drops down with each of the bottom recesses engaging one of the edge protrusions to support the at least one horizontal planar shelf member at any desired height.

8. The system of claim seven wherein the at least one height adjustable rigid horizontal planar shelf member comprises a plurality of rigid horizontal planar elements insertable at different heights between the vertical supports to form an adjustable open shelving piece of furniture.

9. The system of claim 8 further comprising a plurality of drawers each resting at different heights between the vertical supports to form an adjustable drawer chest piece of furniture.

10. The system of claim 7 further comprising at least one vertical door attached by means for pivoting the at least one door attached by pins between a top tie board and a bottom tie board next to at least one of the stacked pairs of vertical supports to form a cabinet.

11. The system of claim 7 wherein the horizontal planar top tie member comprises a desktop to form a desk.

12. The system of claim 7 wherein the at least one pair of vertical supports comprises a vertically stacked array of at least two sets of pairs of vertical supports and further comprising at least one tall door covering the area between the vertical supports to form an armoire.

* * * * *